US011747052B2

(12) United States Patent
Hudson

(10) Patent No.: US 11,747,052 B2
(45) Date of Patent: Sep. 5, 2023

(54) REFRIGERATION SYSTEM

(71) Applicant: GLACIEM COOLING TECHNOLOGIES Pty Ltd., South Australia (AU)

(72) Inventor: Julian Hudson, South Australia (AU)

( * ) Notice: Subject to any disclaimer, the term of this patent is extended or adjusted under 35 U.S.C. 154(b) by 0 days.

(21) Appl. No.: 16/883,160

(22) Filed: May 26, 2020

(65) Prior Publication Data

US 2020/0284477 A1 Sep. 10, 2020

Related U.S. Application Data

(63) Continuation of application No. PCT/AU2018/051262, filed on Nov. 27, 2018.

(30) Foreign Application Priority Data

Nov. 27, 2017 (AU) ..... 2017904783

(51) Int. Cl.

| | |
|---|---|
| ***F25B 39/02*** | (2006.01) |
| ***F25B 39/04*** | (2006.01) |
| ***F25B 9/00*** | (2006.01) |
| ***F25B 49/02*** | (2006.01) |
| ***F25B 41/39*** | (2021.01) |

(52) U.S. Cl.

CPC ..... *F25B 9/008* (2013.01); *F25B 39/02* (2013.01); *F25B 39/04* (2013.01); *F25B 41/39* (2021.01); *F25B 49/022* (2013.01); *F25B 49/027* (2013.01); *F25B 2339/04* (2013.01); *F25B 2700/02* (2013.01); *F25B 2700/2101* (2013.01); *F25B 2700/21161* (2013.01); *F25B 2700/21162* (2013.01)

(58) Field of Classification Search

CPC ..... F25B 9/008; F25B 39/02; F25B 39/04; F25B 49/022; F25B 49/027; F25B 2339/04; F25B 2700/02; F25B 2700/2101; F25B 2700/21161; F25B 2700/21162

See application file for complete search history.

(56) References Cited

U.S. PATENT DOCUMENTS

| | | | |
|---|---|---|---|
| 4,182,131 | A | 1/1980 | Marshall |
| 4,827,733 | A | 5/1989 | Dinh |
| 9,140,471 | B2 | 9/2015 | Kozubal et al. |
| 2004/0144118 | A1 | 7/2004 | Hebert |
| 2005/0028545 | A1 | 2/2005 | Hebert |

(Continued)

FOREIGN PATENT DOCUMENTS

| | | | |
|---|---|---|---|
| CN | 101410678 | A | 4/2009 |
| CN | 102165268 | A | 8/2011 |

(Continued)

*Primary Examiner* — Jonathan Bradford

(74) *Attorney, Agent, or Firm* — Michael Best & Friedrich LLP

(57) ABSTRACT

A $CO_2$ based refrigeration system and a method of operating the $CO_2$ based refrigeration system. The system includes a condenser configured to transfer heat from a $CO_2$ refrigerant of the refrigeration system to an air stream. The system also includes an indirect evaporative cooler arranged to cool an ambient air stream without changing its moisture content and to supply the cooled ambient air to the condenser to facilitate the transfer of heat from the $CO_2$ refrigerant.

21 Claims, 4 Drawing Sheets

(56) References Cited

U.S. PATENT DOCUMENTS

| | | | | |
|---|---|---|---|---|
| 2007/0101746 | A1 | 5/2007 | Schlom et al. | |
| 2008/0011014 | A1* | 1/2008 | Renz | F25B 5/02 62/510 |
| 2009/0178426 | A1* | 7/2009 | Bhatti | F28D 5/02 62/304 |
| 2009/0217679 | A1* | 9/2009 | Raghavachari | F25B 1/10 62/77 |
| 2014/0231042 | A1 | 8/2014 | Curry et al. | |
| 2016/0131384 | A1* | 5/2016 | Yoon | F25B 49/025 700/278 |
| 2017/0122624 | A1 | 5/2017 | Zha et al. | |
| 2017/0153048 | A1 | 6/2017 | Visser | |

FOREIGN PATENT DOCUMENTS

| | | | |
|---|---|---|---|
| CN | 203857600 | U | 10/2014 |
| CN | 107076485 | A | 8/2017 |
| EP | 1550829 | A1 | 7/2005 |
| EP | 1659357 | A1 | 5/2006 |
| EP | 1688685 | A1 | 8/2006 |

* cited by examiner

REFRIGERATION SYSTEM

CROSS-REFERENCE TO RELATED APPLICATIONS

This application is a continuation of International Application No. PCT/AU2018/051262 with a filling date of Nov. 27, 2018, designating the United states, now pending, and further claims the benefit of priority from South Australia Patent Application No. 2017904783, filed on Nov. 27, 2017. The content of the aforementioned application, including any intervening amendments thereto, is incorporated herein by reference in its entirety.

TECHNICAL FIELD

This disclosure relates to refrigeration systems and, in particular, refrigeration systems that make use of carbon dioxide (hereinafter referred to as "$CO_2$") as a refrigerant.

BACKGROUND ART

The vapour compression cycle has been used extensively in the refrigeration industry for many years. The cycle typically employs the continuous flow of refrigerant between four primary components; a metering device, evaporator, compressor and condenser.

The type of refrigerant employed in this cycle varies depending on the application and the refrigeration temperature required. Typically synthetic refrigerants such as CFC's, HCFC's and HFC's have been used. CFC's and HCFC's are in the process of being banned in many countries under the Montreal Protocol due to the ozone depleting potential (ODP) of such refrigerants. Similarly, HFC's are being phased out in those same countries under the Kigali Amendment to the Montreal Protocol due to their high global warming potential (GWP). This phase out in the use of synthetic refrigerants due to their environmental impact has resulted in increased interest in the use of natural refrigerants such as carbon dioxide ($CO_2$), ammonia and hydrocarbons.

In low ambient temperature environments, $CO_2$ refrigeration systems can be more efficient than synthetic refrigerant systems, and for this reason such systems have mostly been used in cooler climates. However, in higher ambient temperatures, the efficiency of $CO_2$ systems can drop significantly. This reduction in efficiency at higher ambient temperatures is due to the low critical temperature of $CO_2$ (approximately 31° C.) when compared to other refrigerants. The critical temperature of a refrigerant is the temperature above which that refrigerant exists in a supercritical state. When a refrigerant is in this state, it is unable to be condensed in the condenser and the efficiency of the system drops significantly.

In refrigeration systems the condenser condenses the refrigerant by transferring heat from the refrigerant to a cooling medium (e.g. air or water). This heat exchange is induced by a temperature difference between the cooling medium and the refrigerant. Because the temperature of the cooling medium is often dependent on the ambient temperature of the immediate environment, when ambient temperatures are higher (such as in hotter climates), it is increasingly difficult to maintain $CO_2$ refrigerant in a subcritical state. For example, ambient temperatures of above 25° C. can result in difficulty maintaining the $CO_2$ refrigerant below its critical temperature.

It is to be understood that, if any prior art is referred to herein, such reference does not constitute an admission that the prior art forms a part of the common general knowledge in the art, in Australia or any other country.

SUMMARY

Disclosed is a $CO_2$ based refrigeration system comprising a condenser for transferring heat from a $CO_2$ refrigerant of the refrigeration system to an air stream. The system further comprises an indirect evaporative cooler arranged to cool an ambient air stream and supply the cooled ambient air to the condenser to facilitate the transfer of heat from the $CO_2$ refrigerant.

As should be appreciated by the skilled person, the term "condenser" encompasses gas coolers. The term gas cooler is used to describe a condenser that is operating under conditions where the refrigerant received by the condenser is supercritical rather than subcritical (i.e. such that it is simply cooled rather than condensed). The condenser, or gas cooler, may be an air-cooled condenser. The condenser may alternatively be a water-cooled condenser and heat may be exchanged between the water and the cooled air.

The provision of cooled ambient (rather than ambient) air to the condenser may allow the $CO_2$ refrigerant to be maintained in a subcritical state, even under ambient conditions that would otherwise lead to a $CO_2$ refrigerant temperature above the critical temperature of $CO_2$ (31° C.).

The use of an evaporative cooler for cooling the ambient air can enable the use of $CO_2$ refrigerant in a broader range of ambient conditions, and can provide an alternative to systems that make use of non-natural refrigerants (such as CFC's, HCFC's and HFC's) that can be harmful to the environment. The use of an evaporative cooler for cooling the ambient air can also be more efficient than other cooling systems, such that the efficiency benefits gained by the use of $CO_2$ as a refrigerant are not lost within the process of cooling the air supplied to the condenser. The use of an indirect evaporative cooler can, in some circumstances, be more cost effective than other cooling systems.

As should be appreciated, the refrigeration system may also be suitable for (and configured for) various applications, including residential air conditioning, commercial air conditioning (including e.g. cool rooms, chilled cabinets, etc.) and vehicle air conditioning.

In one embodiment, the indirect evaporative cooler may comprise a first channel (e.g. a dry channel) for receipt of a first ambient air stream from an air source and a second channel (e.g. a wet channel) separate to the first channel. The second channel may be for receipt of a second air stream and may comprise a wetted surface for supplying water to the second air stream by way of evaporation. The indirect evaporative cooler may further comprise a heat exchanger for exchanging heat between the first and second channels. As is discussed further below, at least a portion of the first ambient and/or second air stream may be supplied to the condenser to facilitate transfer of heat from the $CO_2$ refrigerant. Preferably, however, at least a portion of the first ambient air stream may be supplied to the condenser to facilitate transfer of heat from the $CO_2$ refrigerant.

In this way, the second air stream may be cooled by the evaporation process (i.e. due to energy being transferred from the air and water due to the phase change). Because of a temperature difference between the cooled second air stream and the first ambient air stream (which is initially at the temperature of the air source), heat is transferred from the first ambient air stream to the cooler second air stream.

The evaporation process reduces the dry bulb temperature of the second air stream, but the wet bulb temperature generally remains the same (because of the increase in the moisture entrained in the air). However, in the case of the first ambient air stream, both the wet bulb and dry bulb temperatures are reduced, because the heat loss is a result of heat exchange with the second air stream rather than due to an evaporative process. Hence, the moisture content of the first ambient air stream remains the same.

For brevity, only one pair of first and second channels is discussed, but the refrigeration system may comprise a plurality of first channels and a plurality of second channels that are arranged in various configurations. For example, each first channel may be adjacent (and may exchange heat with) a plurality of second channels and vice versa.

As should be apparent, the system as disclosed herein requires minimal energy input. The minimal energy input is mostly required by and limited to the energy required to move the air through the channels, but also includes energy for e.g. supply of the water to the second channel.

In one embodiment, the indirect evaporative cooler may comprise a diverter to divert at least a portion of the first ambient air stream into the second channel such that the second air stream comprises the diverted portion of the first ambient air stream. The entire first ambient air stream may be diverted, or only a portion of the ambient air stream may be diverted. This may allow the ambient air supplied to the condenser to be cooled to a temperature that is below the wet bulb temperature of the air source (which is not possible with a direct evaporative process). This is because, the cooling (by heat exchange) of the first ambient air stream lowers both the dry bulb and wet bulb temperature. Thus, the diverted portion of the first ambient air stream (which becomes the second air stream) has a lower wet bulb temperature than the air source. This reduces the minimum temperature to which the second air stream can be cooled and, in turn, reduces the temperature to which the first ambient air stream can be cooled (by heat exchange with the second air stream).

This arrangement may improve the ability of the system to maintain the temperature of the $CO_2$ below the critical temperature, so as to maintain the $CO_2$ refrigerant leaving the condenser in a subcritical state. To an extent, the arrangement may allow the $CO_2$ refrigerant to be maintained in this state regardless of the ambient air conditions (e.g. temperature and humidity). Hence, the system may be suitable for use in locations that are otherwise unsuitable for $CO_2$ refrigeration systems.

In one embodiment, the first air stream of the indirect evaporative cooler may comprise the cooled ambient air supplied to the condenser for condensing of the $CO_2$ refrigerant. In another embodiment, the second air stream may comprise the cooled air supplied to the condenser for condensing of the $CO_2$ refrigerant. In another embodiment the first and second air streams may comprise the cooled air supplied to the condenser for condensing of the $CO_2$ refrigerant.

In one embodiment, the system may further comprise a controller arranged to control the supply of cooled ambient air to the condenser. The controller may be a programmable logic controller (PLC). The system may further comprise a fan to move the ambient air through the indirect evaporative cooler. The fan may be a centrifugal fan. The fan may be a backward curved centrifugal fan.

In one embodiment, the controller may be configured to control the fan to control movement of the ambient air through the indirect evaporative cooler. In this way, the power input to the fan may be controlled, and the temperature and pressure of the air supplied by the indirect evaporative cooler may be controlled so as to maximise the efficiency of the refrigeration system.

In one embodiment, the controller may be configured to control a condenser fan for moving the ambient air across coils of the condenser. The condenser fan may be a centrifugal fan. The fan may alternatively be a backward curved centrifugal fan. In some circumstances, a centrifugal fan may provide lower operating power requirements than an axial fan, because of the pressure drop induced by the indirect cooler.

In one embodiment, the controller may be configured to control the supply of cooler ambient air to the condenser based on the relative humidity and temperature of the air source. Again, this may allow the controller to control the system so as to maximise the efficiency of the system. The relative humidity and temperature may be used to determine a condition of the air (e.g. temperature) being supplied to the condenser.

In one embodiment, the controller may be configured to maintain the temperature of the refrigerant in the condenser below a predetermined threshold temperature. The controller may be configured to maintain the temperature of the refrigerant below the critical temperature of the refrigerant. The controller may be configured to maintain the temperature of the refrigerant below a temperature of at least between 30° C.

In one embodiment, the refrigeration system may comprise one or more sensors for measuring the temperature and relative humidity of the air source. The sensors may be positioned at an inlet of the indirect evaporative cooler. The sensors may communicate sensed data to the controller in a wired or wireless manner.

In one embodiment, the refrigeration system may further comprise a metering device (e.g. a high pressure expansion valve) downstream of the condenser. The metering device may be configured to cause supercritical refrigerant, when received from the condenser, to condense. The metering device may, for example, liquefy the supercritical refrigerant by way of throttling. The metering device may provide a backup solution for when the indirect evaporative cooler is unable to maintain the $CO_2$ in a subcritical state.

In one embodiment, the refrigeration system may further comprise a bypass valve. The bypass valve may be configurable between a first position and a second position. In the first position refrigerant may bypass the metering device. In the second position, the refrigerant may pass through the metering device. The bypass valve may be controlled by the controller to move to the first position when the refrigerant is maintained in a subcritical state. The bypass valve may be controlled by the controller to move to the second position when the refrigerant is not maintained in a subcritical state. Such an arrangement may maximise the efficiency of the system when the refrigerant is able to be maintained in a subcritical state, but also allows the system to continue to operate (in a less efficient but useable manner) when the $CO_2$ refrigerant is not subcritical (e.g. due to conditions of the air source (e.g. extreme conditions) or a system fault).

In one embodiment, the refrigeration system may further comprise a receiver vessel, an expansion valve, an evaporator and a compressor. These components may be disposed in this order (i.e. in the direction of flow of the refrigerant). The refrigeration system may further comprise a bypass line for flash gases formed at the metering device. The bypass line may fluidly connect the receiver vessel to the compressor. Flash gases may form at the metering device due to the pressure drop at the metering device. The flash gases may be separated from the $CO_2$ refrigerant in the receiver vessel, and can then be directed to the bypass line to bypass the expansion valve and the evaporator. This can avoid a system efficiency loss that could otherwise occur if flash gases pass through the expansion valve.

In one embodiment, the bypass line may comprise a bypass line valve for selectively restricting the flow of flash gases through the bypass line. The bypass line valve may be opened when the refrigerant is in a supercritical state, and may be closed when the refrigerant is in a subcritical state. The bypass valve may be operated in conjunction with the bypass valve for bypassing the metering device, such that one is closed when the other is open (i.e. to reflect the state of the refrigerant).

In one embodiment, the refrigerant circuit of the refrigeration system may be a closed system.

Also disclosed is a method of operating a $CO_2$ based refrigeration system. The method comprises supplying a first ambient air stream from an air source and cooling a second air stream by moving the second air stream across a wetted surface. The method further comprises transferring heat between the first ambient air stream and the second air stream, and transferring heat between at least a portion of the first ambient air stream and $CO_2$ refrigerant in a condenser of the refrigeration system to condense the $CO_2$.

As is provided above, the evaporative cooling of the second air stream, and the transfer of heat from the first ambient air stream to the second air stream can provide an efficient way to maintain the $CO_2$ below its critical temperature (31° C.). In turn, this may allow the system to operate in an efficient manner (e.g. inefficiency associated with the refrigerant being supercritical may be avoided).

In one embodiment, the method may further comprise diverting a portion of the first ambient air stream. The diverted portion may become the second air stream. In this way, the temperature of the air supplied to the condenser (i.e. for the transfer of heat between the $CO_2$ refrigerant and the air) can be below the wet bulb temperature of the source (e.g. ambient) air. This may otherwise not be the case with direct evaporative cooling. Thus, the present method may not be limited by the wet bulb temperature of the source air and can allow the refrigerant to remain subcritical in locations where this would otherwise not be possible (e.g. due to climatic reasons).

In one embodiment, the method may further comprise controlling the rate at which the ambient air is supplied from the air source and/or the rate at which the ambient air is supplied to the condenser based on a condition of the air source. The condition of the air source may be at least one of the relative humidity and the temperature of the air source. As set forth above, this control may allow the efficiency of the refrigeration system to be maximised (for a particular set of conditions).

In one embodiment, the method may further comprise controlling the rate at which the ambient air is supplied from the air source and/or the rate at which the ambient air is supplied to the condenser to maintain the refrigerant in a subcritical state.

In one embodiment, the method may further comprise determining whether the $CO_2$ refrigerant is in a subcritical or supercritical state at the step of transferring heat in the condenser. If the $CO_2$ refrigerant is determined to be supercritical, the method may comprise reducing the pressure of the $CO_2$ refrigerant by way of a throttling step, to liquefy at least a portion of the $CO_2$ refrigerant. Thus, even if the $CO_2$ refrigerant remains supercritical (e.g. due to system fault or extreme ambient conditions), it may still be liquefied such that the method can still be performed.

Also disclosed is a method of retrofitting a $CO_2$ refrigeration system. The method comprises arranging an indirect evaporative cooler so as to be in fluid connection with an air-cooled condenser of the refrigeration system for supplying cooled air to the air-cooled condenser. This may allow the refrigeration system to operate in a more efficient manner than prior to the retrofitting.

Also disclosed is a $CO_2$ based refrigeration system comprising a condenser for transferring heat from a $CO_2$ refrigerant of the refrigeration system to an air stream, and a metering device downstream of the condenser. The metering device (e.g. a high pressure expansion valve) configured to condense refrigerant from the condenser when received in a supercritical state. The refrigeration system further comprises a bypass arrangement to allow the refrigerant to bypass the metering device.

In one embodiment the bypass arrangement may comprise a valve configurable between a first position and a second position. In the first position, the refrigerant may bypass the metering device. In the second position the refrigerant may pass through the metering device.

In some circumstances, the process of condensing the $CO_2$ refrigerant can result in efficiency losses. By bypassing the metering device (e.g. when such condensing is not required), these efficiency losses may be avoided. The refrigeration system may comprise fittings and components that are formed of a copper or steel alloy able to withstand high pressures. Such high pressures may be experienced when $CO_2$ refrigerant received from the condenser does not pass through the metering device (which may reduce the pressure of the $CO_2$ refrigerant).

In one embodiment the bypass arrangement comprises a bypass line on which the valve disposed.

In one embodiment the refrigeration system may be as otherwise defined above

Also disclosed is a method of operating a $CO_2$ based refrigeration system. The method comprises determining whether $CO_2$ refrigerant being discharged from a condenser of the refrigeration system is in a supercritical state. The method further comprises controlling the system so as to condense the $CO_2$ refrigerant by way of a throttling process when the $CO_2$ refrigerant is determined to be in a supercritical state, and so as to bypass the throttling process when the $CO_2$ is determined to not be in a supercritical state.

BRIEF DESCRIPTION OF THE DRAWINGS

Embodiments will now be described by way of example only, with reference to the accompanying drawings in which.

DETAILED DESCRIPTION

Figure 1:
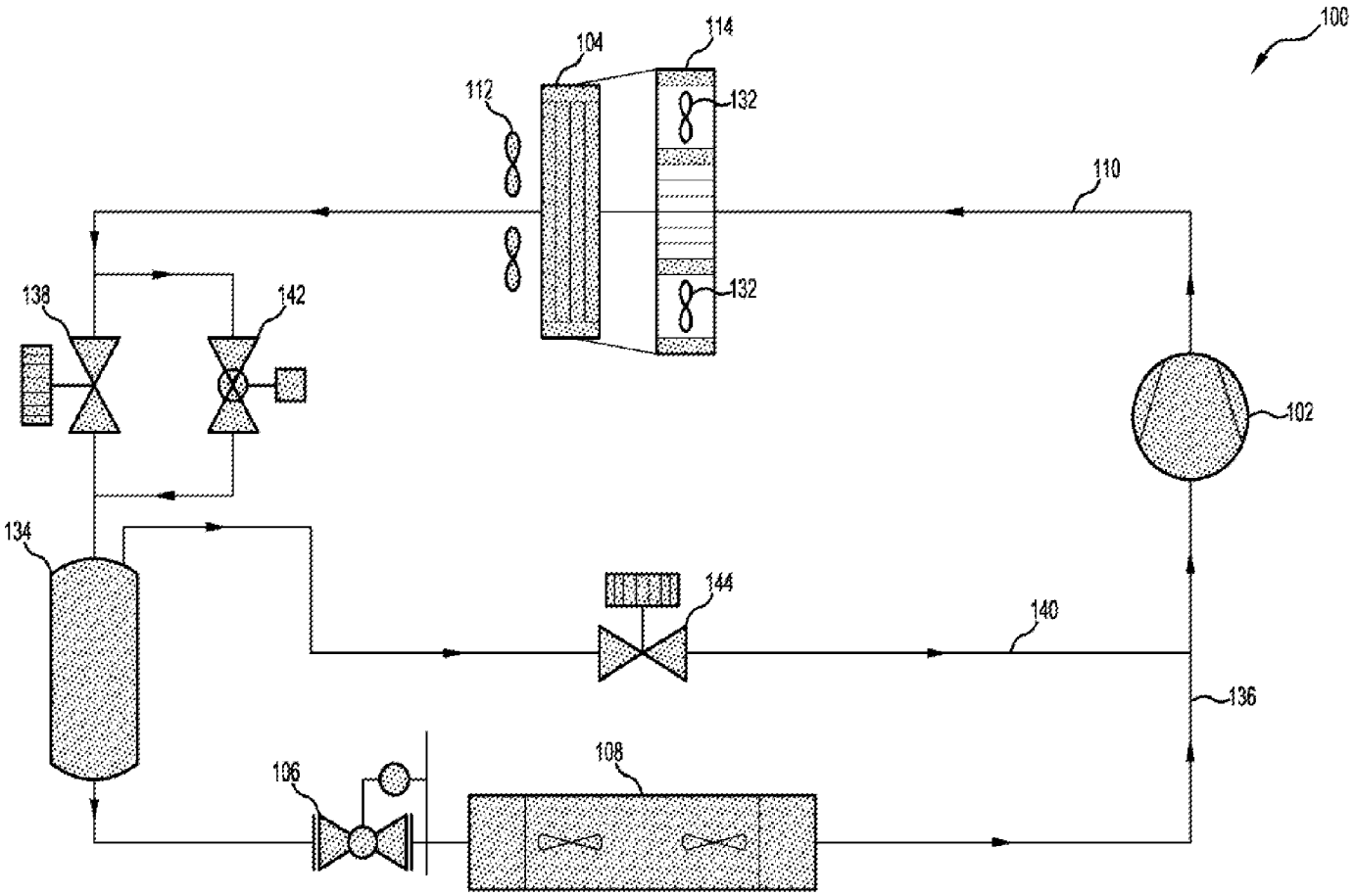
FIG. 1 is a schematic showing a refrigeration system as disclosed herein.

In the following detailed description, reference is made to accompanying drawings which form a part of the detailed description. The illustrative embodiments described in the detailed description, depicted in the drawings and defined in the claims, are not intended to be limiting. Other embodiments may be utilised and other changes may be made without departing from the spirit or scope of the subject matter presented. It will be readily understood that the aspects of the present disclosure, as generally described herein and illustrated in the drawings can be arranged, substituted, combined, separated and designed in a wide variety of different configurations, all of which are contemplated in this disclosure.

FIG. 1 shows a $CO_2$ based refrigeration system (i.e. that uses $CO_2$ as a refrigerant or working fluid) comprising, among other components, a compressor 102, condenser 104, expansion valve 106 and evaporator 108. In general, these components operate in the same manner as in known refrigeration systems.

In operation, $CO_2$ refrigerant is compressed in the compressor 102, which increases the pressure and temperature of the refrigerant. The refrigerant subsequently flows from the discharge side of the compressor, via a discharge line 110, to the condenser 104 for condensing. In the presently described embodiment the condenser 104 is an air cooled condenser (e.g. comprising a coil block and fans 112 that draw air through the coil block to transfer heat from the coil block).

Condensers generally operate by way of heat transfer between a cooling medium and the refrigerant (in this case $CO_2$). In an air cooled condenser, such as the condenser 104 illustrated in FIG. 1, the cooling medium is an air stream (or a plurality of air streams) that flows across conduits (e.g. tubes or coils) containing flowing refrigerant. The heat exchange is driven by a difference in temperature between the cooling medium (in this case, air) and the refrigerant. As a result, during operation, the temperature of the refrigerant in the condenser 104 is higher (e.g. by 3-8K) than the temperature of the air stream. Thus, even when the ambient temperature is below the critical temperature of $CO_2$, the refrigerant temperature can be above the critical temperature (31° C. for $CO_2$), such that the refrigerant exists in a supercritical state. As is set forth above, if the refrigerant is unable to be condensed from a supercritical state to a subcritical state, it can be detrimental to the operation and efficiency of the refrigeration cycle.

To avoid this, or to at least reduce the possibility of this occurring, the presently described embodiment further includes an indirect evaporative cooler 114 that supplies an air stream (or a plurality of air streams) to the condenser 104 for the purpose of transferring heat from the refrigerant. As will be described in further detail below, the indirect evaporative cooler 114 is able to receive an air source (i.e. ambient or outside air) and reduce the temperature of the air, before supplying the cooled air to the condenser 104. In this way, the system 100 is no longer reliant on the ambient temperatures remaining below a particular temperature and, as a result, the refrigerant is able to be maintained in a subcritical state even under high ambient temperatures (e.g. up to 40° C.). Thus, the present system 100 may be operated in locations that would otherwise be unsuitable for $CO_2$ based refrigeration systems.

The indirect evaporative cooler 114 can take various forms, but in general it operates by transferring heat between at least one first air stream that is cooled by an evaporative process, and at least one separate second air stream.

Figure 2:
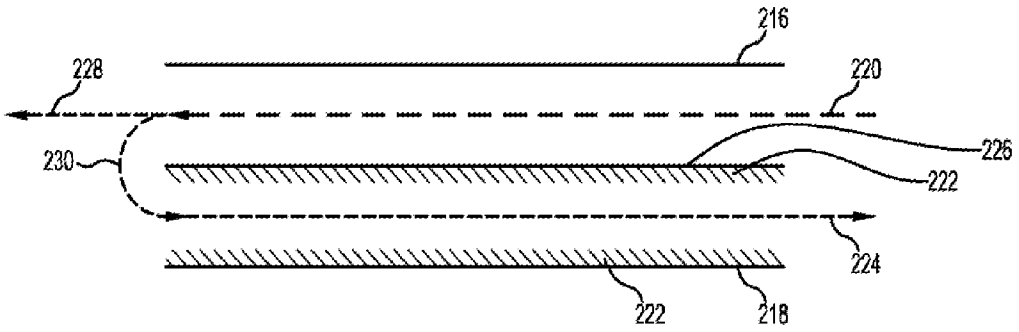
FIG. 2 schematic illustrates the operation of an indirect evaporative cooler.

Operation of the indirect evaporative cooler 114 is best described by reference to FIG. 2. The indirect evaporative cooler 114 of the present embodiment comprises first and second sets of channels that are formed in pads through which the air is drawn. For illustrative purposes, only one first channel 216 and one second channel 218 is shown in FIG. 2 and described below, but one should be aware that in practice a plurality of first channels and a plurality of second channels may be present. The first channel 216 (or the "dry" channel) is separated from the second channel 218 (or the "wet" channel) by a wall 226 that is water impermeable, but that allows heat transfer between the first 216 and second 218 channels.

In operation, the first channel 216 receives a first air stream 220 from an ambient air source (i.e. at ambient temperature). The second channel comprises wetted surfaces 222 and receives a second air stream 224 that causes water on the wetted surfaces 222 to evaporate. The evaporation process results in sensible heat in the air and water becoming latent heat in the vapour, which causes a reduction in temperature of the air and of the water on the wetted surfaces 222. The difference in temperature between the first 216 and second 218 channels drives heat exchange from the first channel 216 to the associated second channel 218 via a heat exchanger in the form of a channel wall 226 (separating the first 216 and second 218 channels). In this way, the first air stream 220 in the first channel 216 is cooled as it flows along the first channel 216. This cooled air stream 228 is then supplied to the condenser (such as the condenser 104 shown in FIG. 1 and described above) for the purpose of transferring heat away from refrigerant in coils, tubes, conduits, etc. of the condenser.

The indirect evaporative cooler also comprises a diverter (not shown) that diverts a portion 230 of the first air stream 220 in each first channel 216 into the second channel 218. In this respect, the diverted portion 230 of the first air stream 220 becomes the second air stream 224 that flows over the wetted surfaces 222 in the second channel 218 (and cools the first air stream 220 via heat exchange across the channel wall 226). The cooled air stream 228 (i.e. that is not diverted) is supplied to the condenser, and the remaining diverted portion (the second air stream 224) is exhausted to the atmosphere, subsequent to it flowing over the wetted surfaces 222.

Such an arrangement means that, in practice, the cooled air stream 228 supplied from the evaporative cooler 114 (e.g. to the condenser) can be at a temperature that is below the wet bulb temperature of the ambient air received by the evaporative cooler 114 (this is not the case with direct evaporative cooling). This is because, as the first air stream 220 is cooled, both the dry and wet bulb temperatures of the first air stream 220 are lowered. Thus, the wet bulb temperature of the second air stream 224 (which is a redirected portion of the first air stream 220) is lower than the ambient wet bulb temperature.

Although not shown, the indirect evaporative cooler 114 further comprises a water supply system that supplies water (e.g. via a pump and spray nozzles) to the second channel 218 (or set of second channels). In some cases, second channels of the indirect evaporative cooler 114 may be oriented to facilitate wetting of the wetted surfaces 222.

Returning back to FIG. 1, the indirect evaporative condenser 114 comprises fans 132 that move air through the channels (216, 218), exhausts humid air (224) and supplies cooled air (228) to the condenser 104. The condenser 104 also comprises a centrifugal fan 112 that moves the supplied air across the coils to transfer heat from the coils to the air. Each of the evaporative cooler 132 and condenser 112 fans can be controlled (e.g. by a PLC) to maintain the condenser pressure at a desired level.

As is set forth above, because the indirect evaporative cooler 114 is capable of supplying air to the condenser 104 at temperatures below the wet bulb temperature of the air, it is possible to maintain the $CO_2$ refrigerant in a subcritical state (i.e. in environments where this would otherwise not be possible due to ambient air temperatures). In this way, inefficiencies associated with supercritical $CO_2$ refrigerant can be avoided.

Under normal operation, the subcritical $CO_2$ is condensed to a liquid in the condenser 104, and flows via a number of components (discussed further below) to the expansion valve 106, via a receiver vessel 134. At the expansion valve 106, the $CO_2$ refrigerant undergoes a pressure drop and lowers in temperature. The refrigerant subsequently passes through the evaporator 108 and heat is transferred to the refrigerant from the surrounding air or process fluid (i.e. so as to cool the surrounding air or process fluid such as milk, wine, water, etc.). Finally, the refrigerant returns to the compressor 102 via a suction line 136 and the cycle is repeated.

The present system 100 also provides means for handling the $CO_2$ when in a supercritical state (i.e. under non-normal operation). For this purpose, the system 100 further includes a high pressure expansion valve 138 connected between the condenser 104 and the receiver vessel 134. As is described above, when the $CO_2$ is supercritical it does not condense into a liquid in the condenser 104. The high pressure expansion valve 138 is configured to create a pressure drop that liquefies the refrigerant, which then flows to the receiver vessel 134 (and subsequently to the expansion valve 106 and evaporator 108).

One consequence of the throttling in the high pressure expansion valve 138 is that it forms a flash gas component, which also flows to the receiver vessel 134 (where it separates from the liquid component). To accommodate the flash gas, the present system further comprises a bypass line 140 connecting the receiver vessel 134 (in which the flash gas is separated from the liquid refrigerant) to the compressor 102. As should be apparent, the flash gas is a portion of the refrigerant that is not useful to the cooling function of the refrigeration system 100 and therefore is representative of an efficiency loss. This loss in efficiency means that the system 102 is more efficient when the $CO_2$ is maintained in a subcritical state.

Nevertheless, even when in a subcritical state, the throttling effect of the high pressure expansion valve 138 results in a reduction in efficiency of the system 100. To avoid this, the present system 100 further includes a first bypass valve 142 that allows the refrigerant to bypass the high pressure expansion valve 138. The first bypass valve 142 may avoid (unnecessary) efficiency losses that would otherwise be present due to the $CO_2$ refrigerant passing through the high pressure expansion valve 138. The refrigeration system 100 may comprise fittings and components able to withstand the high pressure of the $CO_2$ bypassing the high pressure expansion valve 138 (e.g. the fitting and components may comprise a copper or steel alloy).

The system 100 also includes a second bypass valve 144 positioned on the bypass line 140 (between the receiver vessel 134 and the compressor 102) that provides control of refrigerant flow on the bypass line 140.

In this way, when the refrigerant is subcritical (e.g. because the indirect evaporative cooler 114 is operating to maintain it in this state), the first bypass valve 142 can be opened, and the second bypass valve 144 can be closed. This avoids efficiency losses due to throttling in the high pressure expansion valve 138, and closes the bypass line 140 (which is not required, because no flash gases are produced). Conversely, when the refrigerant is supercritical, the first bypass valve 142 can be closed, and the second bypass valve 144 can be opened such that the supercritical refrigerant flows through the high pressure expansion valve 138, and the flash gases (created by the throttling effect) are able to flow from the receiver 134 to the compressor 102 via the bypass line 140.

Figure 3:
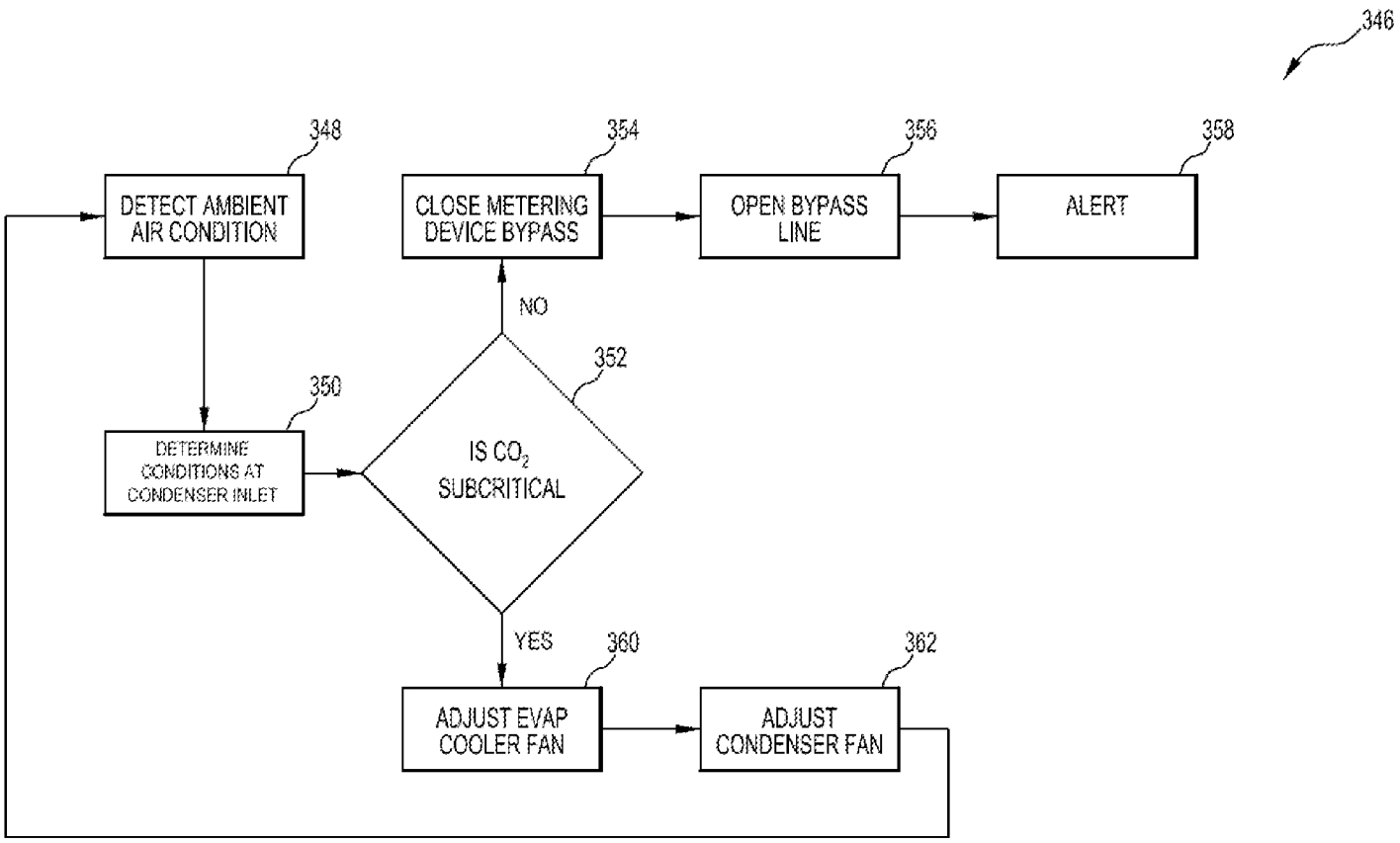
FIG. 3 is a schematic showing a method of operating the refrigeration system shown in FIG. 1A.

This operation of the valves is depicted in FIG. 3, which is a schematic showing exemplary operation of the refrigeration system 100. The control methodology 346 includes detecting ambient air conditions 348 (i.e. the conditions of the air received by the indirect evaporative cooler 114 for cooling). These conditions may be, for example, the humidity and the temperature of the ambient air and may be detected by suitable sensors (these sensors are discussed in more detail with reference to FIGS. 4A, B and C).

The detected conditions can then be used to determine the conditions at the condenser inlet 350, which can in turn be used to determine whether the $CO_2$ refrigerant is in a supercritical state 352.

If the $CO_2$ refrigerant is supercritical, then the first bypass valve 142 on the high pressure expansion valve bypass (which is normally configured in an open position) is closed 354, which causes refrigerant to flow through the high pressure expansion valve 138. This allows the supercritical $CO_2$ refrigerant to be liquefied by the high pressure expansion valve 138. At the same time, the second bypass valve 144 on the bypass line 140 is opened 356, which allows the flash gas component (formed at the high pressure expansion valve 138) to bypass the expansion valve 106 and the evaporator 108. That is, the flash gas flows, via the bypass line 140, directly to the compressor 102.

An alert may also be raised 358 to notify an operator that the system 100 is operating in a supercritical state. The operator can then correct any issues that might be causing the system 100 to run in this state (i.e. apart from extreme climate conditions).

If, on the other hand, the $CO_2$ refrigerant is determined to be in a subcritical state, the indirect evaporative cooler fan 132 and the condenser fan 112 may be controlled 360, 362 (depending on the detected ambient air conditions) to achieve a desired condenser pressure for maximising efficiency of the system 100.

Figure 4C:
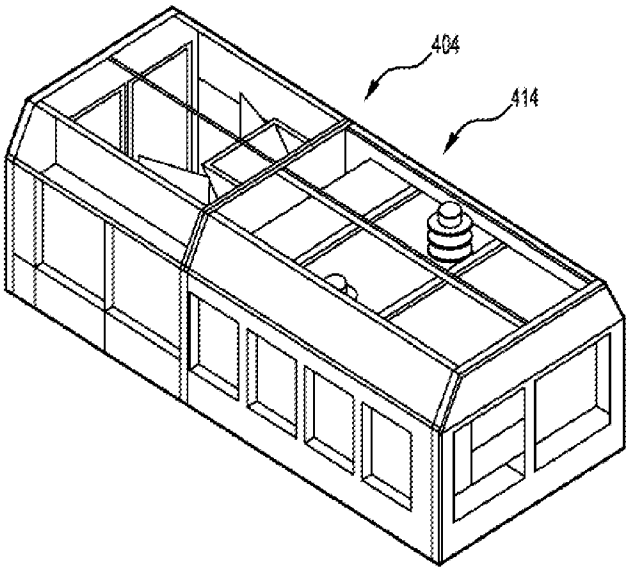
FIGS. 4A, 4B and 4C are top, side and perspective views of a condenser/indirect evaporative cooler assembly.
Figure 4A:
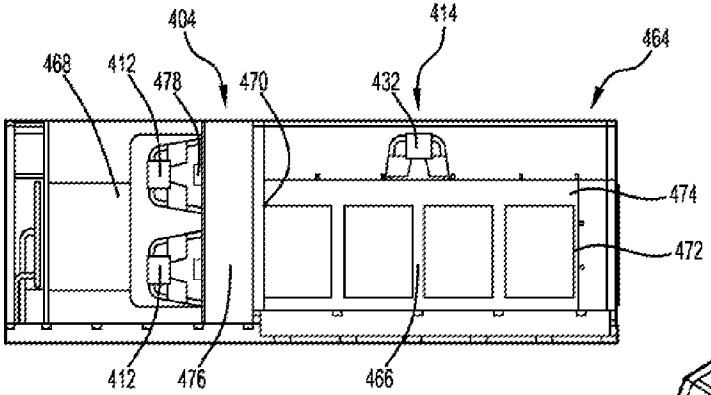
Figure 4B:
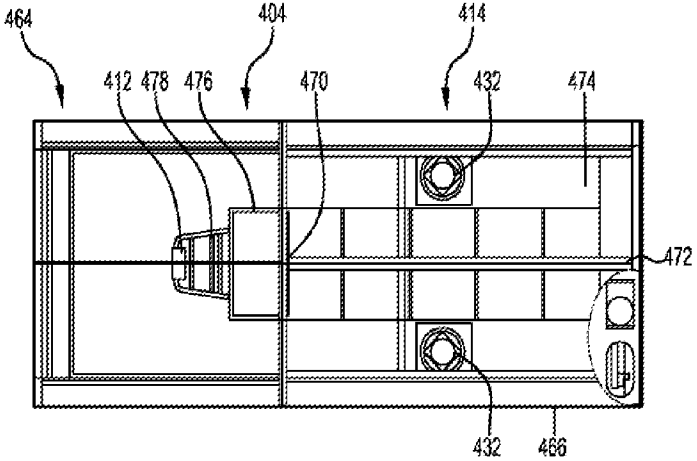

FIG. 4 depicts an exemplary indirect evaporative cooler 414 and condenser 404 assembly 464 that may be used in a refrigeration system, such as the refrigeration system 100 described above. The assembly 464 comprises a plurality of sensors that can communicate data to a controller (not shown) so that the condenser 404 and indirect evaporative cooler 414 can be controlled in a manner that e.g. maximises efficiency of the system.

The assembly 464 comprises a humidity and temperature sensor 466 disposed at an inlet of the indirect evaporative cooler 414. This sensor 466 measures the humidity and temperature of the ambient air that is supplied to the indirect evaporative cooler 414. The assembly 464 also comprises condenser outlet 468 and condenser inlet 470 temperature sensors that detect the temperature of air entering and leaving the condenser 404. Also provided is an indirect evaporative cooler inlet pressure sensor 472, an indirect evaporative cooler exhaust pressure sensor 474, a condenser pressure sensor 476 and a condenser fan pressure sensor 478.

The data from these sensors is transmitted (e.g. wirelessly or via wired connection) to a controller. The controller makes use of this data to control aspects of the assembly, such as the condenser fans 412 and/or indirect evaporative cooler fans 432 to maximise efficiency.

Variations and modifications may be made to the parts previously described without departing from the spirit or ambit of the disclosure.

For example, the system may include additional components not discussed above, or may be configured in an alternative manner.

The indirect evaporative cooler may be arranged alternatively to that described above. For illustrative purposes, FIG. 2 shows a single dry (first) channel and a single wet (second) channel, but it should be understood that the indirect evaporative cooler can comprise a plurality of dry channels and a plurality of wet channels. For example, each dry channel may be adjacent to a plurality of wet channels (and vice versa).

Similarly, it may not be necessary that a portion of the first air stream be diverted to form the second air stream. Instead, the first (dry) air stream and second (wet) air stream may remain separate so as to be in a cross-flow arrangement. The first and second air streams may not be parallel to one another, and may instead be e.g. perpendicular to one another.

Further, and as would be appreciated by the skilled person, the means for providing water to the channels may be other than via spray nozzles.

In the claims which follow and in the preceding description, except where the context requires otherwise due to express language or necessary implication, the word "comprise" or variations such as "comprises" or "comprising" is used in an inclusive sense, i.e. to specify the presence of the stated features but not to preclude the presence or addition of further features in various embodiments of the $CO_2$ based refrigeration system.

What is claimed is:

1. A $CO_2$ based refrigeration system comprising:

a condenser configured to transfer heat from a $CO_2$ refrigerant of the refrigeration system to an air stream; and an indirect evaporative cooler arranged to cool an ambient air stream without changing its moisture content, the indirect evaporative cooler being arranged to supply the cooled ambient air from the indirect evaporative cooler to the condenser to facilitate the transfer of heat from the $CO_2$ refrigerant, wherein the indirect evaporative cooler comprises:

a first channel for receipt of a first ambient air stream from an air source;

a second channel separate to the first channel, the second channel for receipt of a second air stream and comprising a wetted surface for supplying water to the second air stream by way of evaporation; and a heat exchanger for exchanging heat between the first and second channels, wherein the second channel is separated from the first channel by a water-impermeable wall configured so that the first ambient air stream received in the first channel is separated from the second air stream in the second channel.

2. The refrigeration system according to claim 1 wherein the indirect evaporative cooler comprises a diverter to divert at least a portion of the first ambient air stream into the second channel, whereby the second air stream comprises the diverted portion of the first ambient air stream.

3. The refrigeration system according to claim 1 wherein the first air stream of the indirect evaporative cooler comprises the cooled ambient air supplied to the condenser for condensing of the $CO_2$ refrigerant.

4. The refrigeration system according to claim 1 comprising a controller arranged to control the supply of cooled ambient air to the condenser.

5. The refrigeration system according to claim 4 comprising a fan to move the ambient air through the indirect evaporative cooler, and wherein the controller is configured to control the fan to control movement of the ambient air through the indirect evaporative cooler.

6. The refrigeration system according to claim 4 wherein the controller is configured to control a condenser fan for moving cooled ambient air across coils of the condenser, based on the relative humidity and temperature of the air source.

7. The refrigeration system according to claim 4 wherein the controller is configured to maintain the temperature of the refrigerant in the condenser below a predetermined threshold temperature.

8. The refrigeration system according to claim 1 comprising one or more sensors for measuring the temperature and relative humidity of the air source.

9. The refrigeration system according to claim 1 further comprising a metering device downstream of the condenser, the metering device configured to create a pressure drop so that part of the refrigerant liquefies, when received in a supercritical state from the condenser.

10. The refrigeration system according to claim 9 comprising a bypass valve configurable between:

a first position in which refrigerant bypasses the metering device; and a second position in which the refrigerant passes through the metering device.

11. The refrigeration system according to claim 2 wherein the diverter is located at an output end of the first channel such that the portion of the first ambient air stream diverted into the second channel is diverted into the input end of the second channel, the first and second channels being configured such that the first ambient air stream flows through the first channel in a direction opposite to the flow of the second air stream in the second channel.

12. A method of operating a $CO_2$ based refrigeration system, the method comprising:

supplying a first ambient air stream from an air source;

cooling a second air stream by moving the second air stream across a wetted surface;

transferring heat between the first ambient air stream and the second air stream to cool the first ambient air stream without changing its moisture content, thereby producing a cooled first air stream;

supplying at least a portion of the cooled first air stream to a condenser of the refrigeration system; and transferring heat between at least a portion of the cooled first air stream and $CO_2$ refrigerant in the condenser of the refrigeration system to condense the $CO_2$.

13. The method according to claim 12 further comprising diverting a portion of the cooled first air stream, the diverted portion comprising the second air stream.

14. The method according to claim 12 further comprising controlling the rate at which the ambient air is supplied from the air source and/or the rate at which cooled air from the cooled first air stream is supplied to the condenser based on at least one of relative humidity and temperature of the air source.

15. The method according to claim 14 comprising controlling the rate at which the ambient air is supplied from the air source and/or the rate at which cooled air from the cooled first air stream is supplied to the condenser to maintain the refrigerant in a subcritical state.

16. The method according to claim 12 further comprising determining whether the $CO_2$ refrigerant is in a subcritical or supercritical state at the step of transferring heat in the condenser.

17. The method according to claim 16 wherein, if the $CO_2$ refrigerant is determined to be supercritical, the method further comprises reducing the pressure of the $CO_2$ refrigerant by way of throttling, to liquefy at least a portion of the $CO_2$ refrigerant.

18. A $CO_2$ based refrigeration system comprising:

a condenser configured to transfer heat from a $CO_2$ refrigerant of the refrigeration system to an air stream;

an indirect evaporative cooler arranged to cool an ambient air stream without changing its moisture content, the indirect evaporative cooler being arranged to supply the cooled ambient air from the indirect evaporative cooler to the condenser to facilitate the transfer of heat from the $CO_2$ refrigerant, wherein the indirect evaporative cooler comprises:

a first channel for receipt of a first ambient air stream from an air source;

a second channel separate to the first channel, the second channel for receipt of a second air stream and comprising a wetted surface for supplying water to the second air stream by way of evaporation; and a heat exchanger for exchanging heat between the first and second channels, wherein the second channel is separated from the first channel by a water-impermeable wall configured so that the first ambient air stream received in the first channel is separated from the second air stream in the second channel;

a metering device downstream of the condenser, the metering device configured to create a pressure drop so that part of the refrigerant liquefies, when received in a supercritical state, from the condenser such that a liquid component and a flash gas component are generated; and a bypass arrangement configured to allow the refrigerant to bypass the metering device, wherein the bypass arrangement comprises a valve and a bypass line.

19. The refrigeration system according to claim 18 wherein the valve is configurable between:

a first position in which refrigerant bypasses the metering device; and a second position in which the refrigerant passes through the metering device.

20. The refrigeration system according to claim 19 wherein the valve is disposed on the bypass line.

21. A refrigeration system comprising:

a condenser configured to transfer heat from a refrigerant of the refrigeration system to an air stream; and an indirect evaporative cooler arranged to cool an ambient air stream without changing its moisture content, the indirect evaporative cooler being arranged to supply the cooled ambient air from the indirect evaporative cooler to the condenser to facilitate the transfer of heat from the refrigerant, wherein the indirect evaporative cooler comprises:

a first channel for receipt of a first ambient air stream from an air source, a second channel for receipt of a second air stream and comprising a wetted surface for supplying water to the second air stream by way of evaporation, and a heat exchanger for exchanging heat between the first and second channels, wherein the second channel is separate from the first channel so that heat is exchanged between the first and second channels without changing the moisture content of the first ambient air stream in the first channel.

* * * * *